US006163898A

United States Patent [19]

Misch

[11] Patent Number: 6,163,898

[45] Date of Patent: Dec. 26, 2000

[54] HAND HELD BIDET AND ORGANIZING STORAGE CABINET ASSEMBLY

[75] Inventor: Beverly A. Misch, Fontana, Calif.

[73] Assignee: William H. Misch, Jr., Fontana, Calif.; a part interest

[21] Appl. No.: 09/534,479

[22] Filed: Mar. 24, 2000

[51] Int. Cl.[7] ..... A47K 3/26

[52] U.S. Cl. ..... 4/443; 4/448; 4/420.4

[58] Field of Search ..... 4/443, 447, 448, 4/567, 664, 420.4; 604/150, 529; 312/209

[56] References Cited

U.S. PATENT DOCUMENTS

| | | | |
|---|---|---|---|
| 3,865,271 | 2/1975 | Gold | 4/443 X |
| 4,312,345 | 1/1982 | Colvin | 604/259 X |
| 5,666,676 | 9/1997 | Roemen et al. | 4/443 |
| 5,954,411 | 9/1999 | Katz | 312/242 |

FOREIGN PATENT DOCUMENTS

| | | | |
|---|---|---|---|
| 2730714 | 1/1979 | Germany . | |
| 1535794 | 12/1978 | United Kingdom | 4/448 |

*Primary Examiner*—Henry J. Recla
*Assistant Examiner*—Kathleen J. Prunner

[57] ABSTRACT

A hand held bidet and organizing storage cabinet assembly for providing discreet concealment of a hand held bidet and washroom supplied. The hand held bidet and organizing storage cabinet assembly includes a housing comprising an open front face. The housing is adapted for coupling to a support structure proximate a toilet. A substantially horizontal shelf extends longitudinally through an interior space of the housing. A nozzle comprises a handle whereby the nozzle is holdable in a hand of a user. A flexible water conduit comprises a distal end coupled to the nozzle for delivering water for dispersal through the nozzle. The nozzle is positionable for use as a bidet when the user is seated on the toilet. A tray is coupled to an interior bottom face of the housing. The tray is slidable to extend outwardly through the open front face of the housing to define an extended position. The tray is positionable fully within an interior space of the housing to define a storage position. A front cover is for selectively covering the open front face of the housing when the tray is in the storage position. The front cover comprises a handle positioned proximate a distal end of the front cover opposite a first end of the front cover. The handle is for facilitating movement of the front cover between an open position and a closed position.

12 Claims, 2 Drawing Sheets

HAND HELD BIDET AND ORGANIZING STORAGE CABINET ASSEMBLY

BACKGROUND OF THE INVENTION

1. Field of the Invention

The present invention relates to bidet sprayer units and more particularly pertains to a new hand held bidet and organizing storage cabinet assembly for providing discreet concealment of a hand held bidet and washroom supplied.

2. Description of the Prior Art

The use of bidet sprayer units is known in the prior art. More specifically, bidet sprayer units heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,596,058; U.S. Pat. No. 5,809,585; U.S. Pat. No. 5,685,028; U.S. Pat. No. 5,023,961; U.S. Pat. No. 5,720,055; and U.S. Pat. No. Des. 358,872.

While these devices fulfill their respective, particular objectives and requirements, the aforementioned patents do not disclose a new hand held bidet and organizing storage cabinet assembly. The inventive device includes a housing comprising an open front face. The housing is adapted for coupling to a support structure proximate a toilet. A substantially horizontal shelf extends longitudinally through an interior space of the housing. A nozzle comprises a handle whereby the nozzle is holdable in a hand of a user. A flexible water conduit comprises a distal end coupled to the nozzle for delivering water for dispersal through the nozzle. The nozzle is positionable for use as a bidet when the user is seated on the toilet. A tray is coupled to an interior bottom face of the housing. The tray is slidable to extend outwardly through the open front face of the housing to define an extended position. The tray is positionable fully within an interior space of the housing to define a storage position. A front cover is for selectively covering the open front face of the housing when the tray is in the storage position. The front cover comprises a handle positioned proximate a distal end of the front cover opposite a first end of the front cover. The handle is for facilitating movement of the front cover between an open position and a closed position.

In these respects, the hand held bidet and organizing storage cabinet assembly according to the present invention substantially departs from the conventional concepts and designs of the prior art, and in so doing provides an apparatus primarily developed for the purpose of providing discreet concealment of a hand held bidet and washroom supplied.

SUMMARY OF THE INVENTION

In view of the foregoing disadvantages inherent in the known types of bidet sprayer units now present in the prior art, the present invention provides a new hand held bidet and organizing storage cabinet assembly construction wherein the same can be utilized for providing discreet concealment of a hand held bidet and washroom supplied.

The general purpose of the present invention, which will be described subsequently in greater detail, is to provide a new hand held bidet and organizing storage cabinet assembly apparatus and method which has many of the advantages of the bidet sprayer units mentioned heretofore and many novel features that result in a new hand held bidet and organizing storage cabinet assembly which is not anticipated, rendered obvious, suggested, or even implied by any of the prior art bidet sprayer units, either alone or in any combination thereof.

To attain this, the present invention generally comprises a housing comprising an open front face. The housing is adapted for coupling to a support structure proximate a toilet. A substantially horizontal shelf extends longitudinally through an interior space of the housing. A nozzle comprises a handle whereby the nozzle is holdable in a hand of a user. A flexible water conduit comprises a distal end coupled to the nozzle for delivering water for dispersal through the nozzle. The nozzle is positionable for use as a bidet when the user is seated on the toilet. A tray is coupled to an interior bottom face of the housing. The tray is slidable to extend outwardly through the open front face of the housing to define an extended position. The tray is positionable fully within an interior space of the housing to define a storage position. A front cover is for selectively covering the open front face of the housing when the tray is in the storage position. The front cover comprises a handle positioned proximate a distal end of the front cover opposite a first end of the front cover. The handle is for facilitating movement of the front cover between an open position and a closed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hand held bidet and organizing storage cabinet assembly apparatus and method which has many of the advantages of the bidet sprayer units mentioned heretofore and many novel features that result in a new hand held bidet and organizing storage cabinet assembly which is not anticipated, rendered obvious, suggested, or even implied by any of the prior art bidet sprayer units, either alone or in any combination thereof.

It is another object of the present invention to provide a new hand held bidet and organizing storage cabinet assembly which may be easily and efficiently manufactured and marketed.

It is a further object of the present invention to provide a new hand held bidet and organizing storage cabinet assembly which is of a durable and reliable construction.

An even further object of the present invention is to provide a new hand held bidet and organizing storage cabinet assembly which is susceptible of a low cost of manufacture with regard to both materials and labor, and which accordingly is then susceptible of low prices of sale to the consuming public, thereby making such hand held bidet and organizing storage cabinet assembly economically available to the buying public.

Still yet another object of the present invention is to provide a new hand held bidet and organizing storage cabinet assembly which provides in the apparatuses and methods of the prior art some of the advantages thereof, while simultaneously overcoming some of the disadvantages normally associated therewith.

Still another object of the present invention is to provide a new hand held bidet and organizing storage cabinet assembly for providing discreet concealment of a hand held bidet and washroom supplied.

Yet another object of the present invention is to provide a new hand held bidet and organizing storage cabinet assembly which includes a housing comprising an open front face. The housing is adapted for coupling to a support structure proximate a toilet. A substantially horizontal shelf extends longitudinally through an interior space of the housing. A nozzle comprises a handle whereby the nozzle is holdable in a hand of a user. A flexible water conduit comprises a distal end coupled to the nozzle for delivering water for dispersal through the nozzle. The nozzle is positionable for use as a bidet when the user is seated on the toilet. A tray is coupled to an interior bottom face of the housing. The tray is slidable to extend outwardly through the open front face of the housing to define an extended position. The tray is positionable fully within an interior space of the housing to define a storage position. A front cover is for selectively covering the open front face of the housing when the tray is in the storage position. The front cover comprises a handle positioned proximate a distal end of the front cover opposite a first end of the front cover. The handle is for facilitating movement of the front cover between an open position and a closed position.

Still yet another object of the present invention is to provide a new hand held bidet and organizing storage cabinet assembly that provides a hand held bidet to the user of a toilet.

Even still another object of the present invention is to provide a new hand held bidet and organizing storage cabinet assembly that provides discreet concealment of supplies commonly used in a washroom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
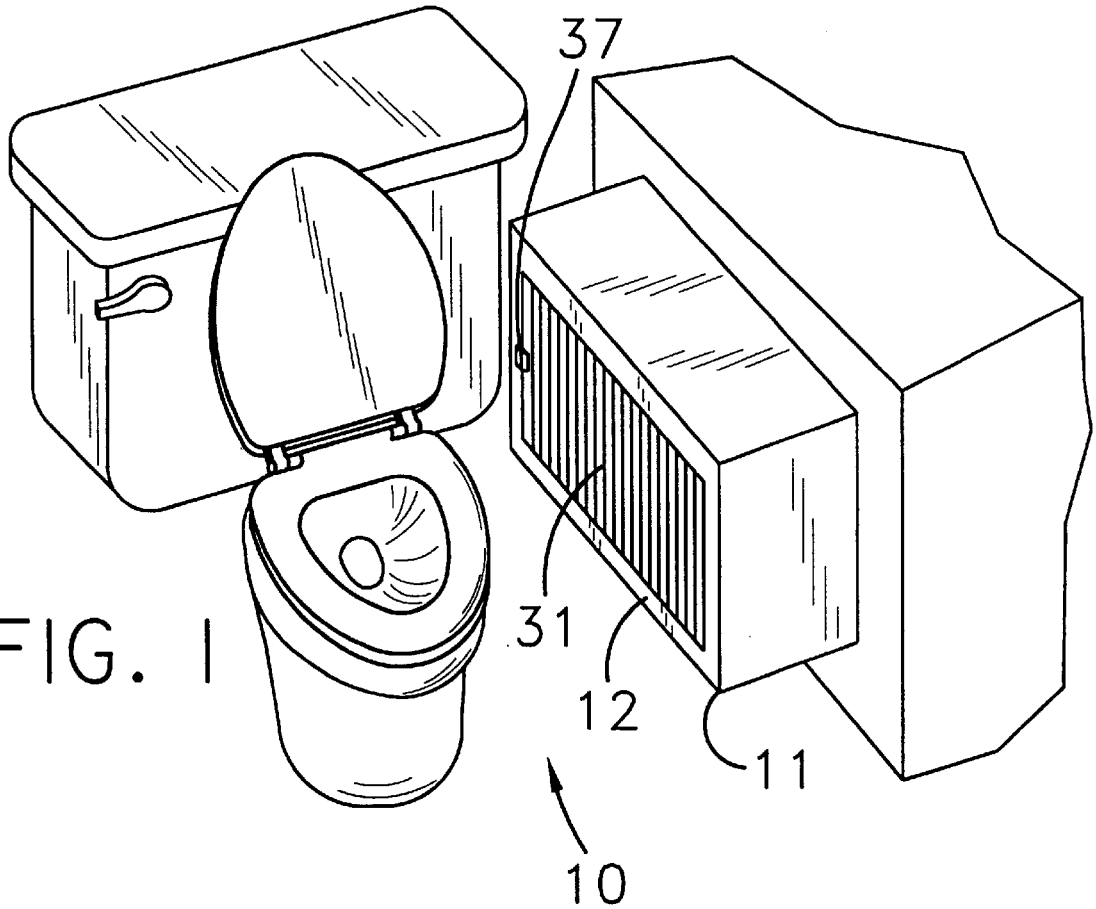
FIG. 1 is a perspective view of a new hand held bidet and organizing storage cabinet assembly according to the present invention.
Figure 2:
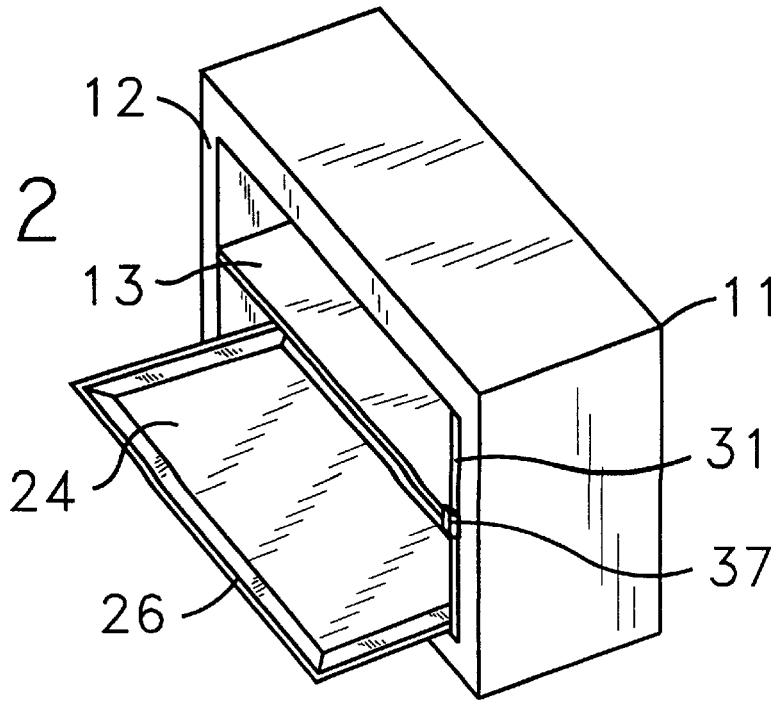
FIG. 2 is a perspective view of the present invention.

With reference now to the drawings, and in particular to FIGS. 1 through 4 thereof, a new hand held bidet and organizing storage cabinet assembly embodying the principles and concepts of the present invention and generally designated by the reference numeral 10 will be described.

As best illustrated in FIGS. 1 through 4, the hand held bidet and organizing storage cabinet assembly 10 generally comprises a generally rectangular housing 11 comprising an open front face 12. The housing is adapted for coupling to a support structure proximate a toilet. The housing has a length of about 21 inches. A substantially horizontal shelf 13 extends longitudinally through an interior space 14 of the housing. The shelf has a width of between 6 and 7 inches to match the depth of the housing.

Figure 3:
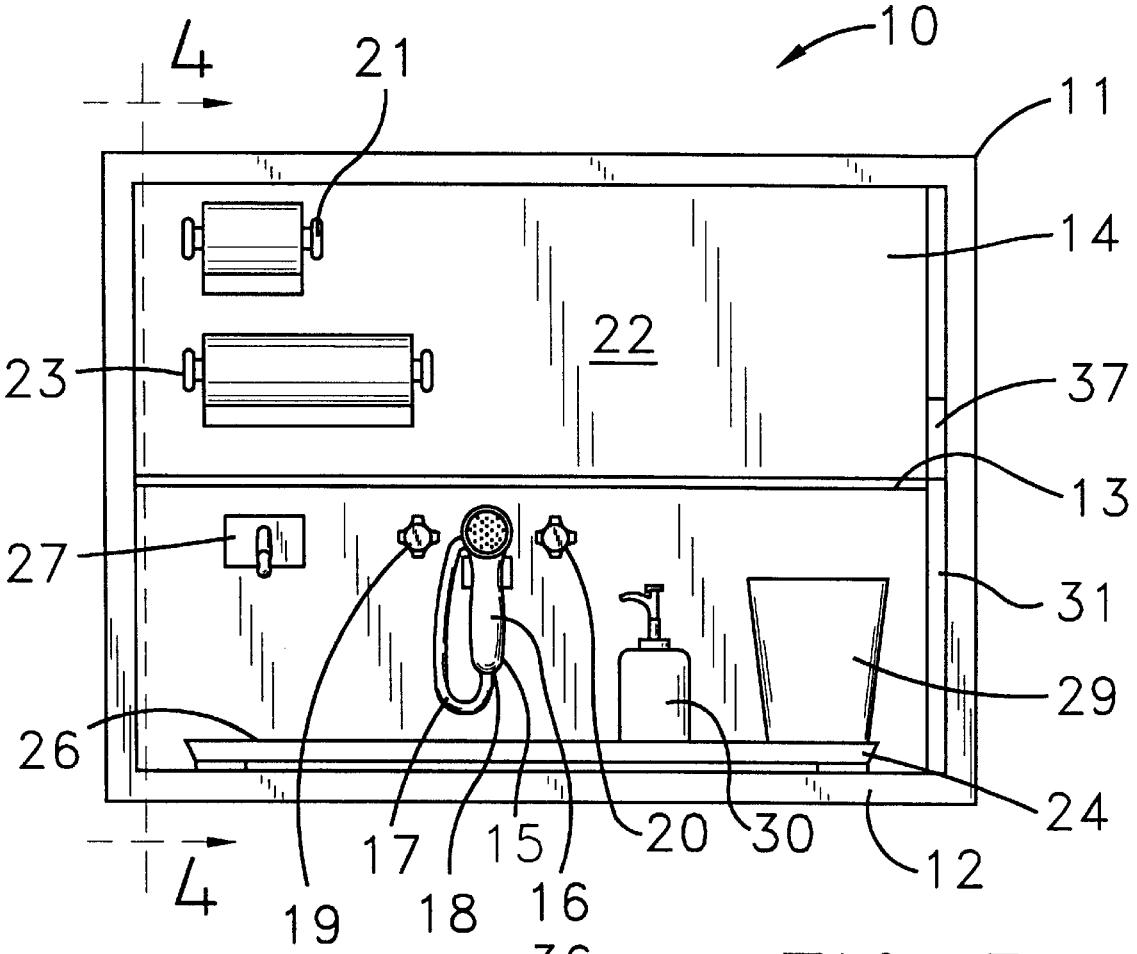
FIG. 3 is an elevational view of the present invention.
Figure 4:
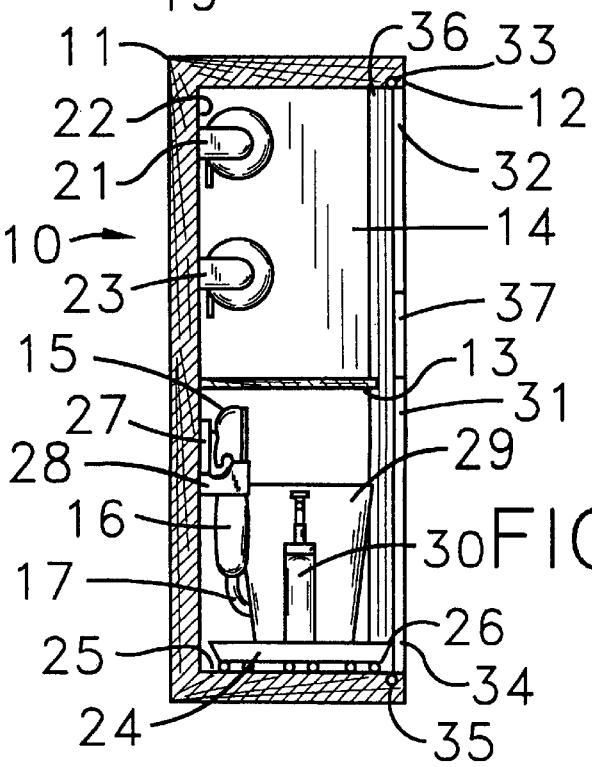
FIG. 4 is a cross sectional view of the present invention taken along line 4—4 of FIG. 3.

As shown in FIGS. 3 and 4, a nozzle 15 comprises a handle 16 whereby the nozzle is holdable in a hand of a user. A flexible water conduit 17 comprises a distal end 18 coupled to the nozzle for delivering water for dispersal through the nozzle whereby the nozzle is positionable for use as a bidet when the user is seated on the toilet. A hot water control valve 19 is operationally coupled to the water conduit for controlling an amount of hot water passing through the water conduit. A cold water control valve 20 is operationally coupled to the water conduit for controlling an amount of cold water passing through the water conduit.

A toilet paper roll holder 21 is coupled to an interior back face 22 of the housing. The toilet paper roll holder is for holding a roll of toilet paper. A paper towel roll holder 23 is coupled to the interior back face of the housing. The paper towel roll holder is for holding a roll of paper towels.

A tray 24 is coupled to an interior bottom face 25 of the housing. The tray is slidable to extend outwardly through the open front face of the housing to define an extended position. The tray is positionable fully within an interior space of the housing to define a storage position. The tray comprises a perimeter lip 26 whereby the tray is adapted for preventing objects from sliding off of the tray when the tray is moved between the extended position and the storage position.

A hook 27 is coupled to the interior back face of the housing. The hook extends outwardly from the interior back face of the housing such that the hook is adapted for holding an item over the tray when the tray is in the storage position. A nozzle clip member 28 is coupled to the interior back face of the housing. The nozzle clip member is for holding the nozzle when the nozzle is not being used.

Also shown in FIGS. 3 and 4, a waste basket 29 is positioned inside the housing. The waste basket is for placing on the tray. A soap dispenser 30 is for positioning on the tray. The soap dispenser is for selectively dispensing soap upon depression of a pump of the soap dispenser.

A front cover 31 is for selectively covering the open front face of the housing when the tray is in the storage position. The front cover is a rolling cover comprising a top edge 32 positioned within an upper cover track 33 and a lower portion 34 positioned with a lower cover track 35. The cover comprises a first end coupled to a spool 36. The spool is rotatable around a longitudinal axis of the spool. The spool is for holding the cover when the cover is in an open position. The open position is defined by the front cover being wrapped around the spool for providing access to the interior space of the housing. The front cover is extendable into a closed position defined by the front cover covering the open front face of the housing for preventing access to the interior space of the housing.

The front cover comprises a handle 37 positioned proximate a distal end of the front cover opposite the first end. The handle is for facilitating movement of the front cover between the open position and the closed position.

In use, the user after using the toilet would retrieve the nozzle from the cabinet and adjust the water temperature for comfort and use the nozzle to clean up. The soap dispenser would then be readily available for use on the pull out tray. The user could then also use the paper towel dispenser for other cleaning tasks around the bathroom and dispose of the used paper towels in the waste basket in the housing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bidet and organizing storage cabinet assembly comprising:

a housing having an open front face, said housing being adapted for coupling to a support structure proximate a toilet;

a substantially horizontal shelf extending longitudinally through an interior space of said housing;

a nozzle, said nozzle having a handle whereby said nozzle is holdable in a hand of a user;

a flexible water conduit having a distal end coupled to said nozzle for delivering water for dispersal through said nozzle whereby said nozzle is positionable for use as a bidet when the user is seated on the toilet;

a tray coupled to an interior bottom face of said housing, said tray being slidable to extend outwardly through said open front face of said housing to define an extended position, said tray being positionable fully within said interior space of said housing to define a storage position;

a toilet paper roll holder coupled to an interior back face of said housing, said toilet paper roll holder being for holding a roll of toilet paper;

a front cover for selectively covering said open front face of said housing when said tray is in said storage position; and said front cover having a handle positioned proximate a distal end of said front cover opposite a first end of said front cover, said handle being for facilitating movement of said front cover between an open position and a closed position.

2. The storage cabinet assembly as set forth in claim 1, further comprises a hot water control valve operationally coupled to said water conduit for controlling an amount of hot water passing through said water conduit.

3. The storage cabinet assembly as set forth in claim 2, further comprises a cold water control valve operationally coupled to said water conduit for controlling an amount of cold water passing through said water conduit.

4. The storage cabinet assembly as set forth in claim 1, further comprises a paper towel roll holder coupled to said interior back face of said housing, said paper towel roll holder being for holding a roll of paper towels.

5. The storage cabinet assembly as set forth in claim 1, wherein said tray has a perimeter lip whereby said tray is adapted for preventing objects from sliding off of said tray when said tray is moved between said extended position and said storage position.

6. The storage cabinet assembly as set forth in claim 1, further comprises a hook coupled to said interior back face of said housing, said hook extending outwardly from said interior back face of said housing such that said hook is adapted for holding an item over said tray when said tray is in said storage position.

7. The storage cabinet assembly as set forth in claim 1, further comprises a nozzle clip member coupled to said interior back face of said housing, said nozzle clip member being for holding said nozzle when said nozzle is not being used.

8. The storage cabinet assembly as set forth in claim 1, further comprises a waste basket positioned inside said housing, said waste basket being for placing on said tray.

9. The storage cabinet assembly as set forth in claim 1, further comprises a soap dispenser for positioning on said tray, said soap dispenser being for selectively dispensing soap upon depression of a pump of said soap dispenser.

10. The storage cabinet assembly as set forth in claim 1, wherein said front cover is a rolling cover having a top edge positioned within an upper cover track and a lower portion positioned with a lower cover track.

11. The storage cabinet assembly as set forth in claim 10, wherein said first end of said cover is coupled to a spool, said spool being rotatable around a longitudinal axis of said spool, said spool being for holding said cover when said cover is in said open position, said open position being defined by said front cover being wrapped around said spool for providing access to said interior space of said housing, said front cover being extendable into said closed position defined by said front cover covering said open front face of said housing for preventing access to said interior space of said housing.

12. A bidet and organizing storage cabinet assembly comprising:

a generally rectangular housing having an open front face, said housing being adapted for coupling to a support structure proximate a toilet;

a substantially horizontal shelf extending longitudinally through an interior space of said housing;

a nozzle, said nozzle having a handle whereby said nozzle is holdable in a hand of a user;

a flexible water conduit having a distal end coupled to said nozzle for delivering water for dispersal through said nozzle whereby said nozzle is positionable for use as a bidet when the user is seated on the toilet;

a hot water control valve operationally coupled to said water conduit for controlling an amount of hot water passing through said water conduit;

a cold water control valve operationally coupled to said water conduit for controlling an amount of cold water passing through said water conduit;

a toilet paper roll holder coupled to an interior back face of said housing, said toilet paper roll holder being for holding a roll of toilet paper;

a paper towel roll holder coupled to said interior back face of said housing, said paper towel roll holder being for holding a roll of paper towels;

a tray coupled to an interior bottom face of said housing, said tray being slidable to extend outwardly through said open front face of said housing to define an extended position, said tray being positionable fully within said interior space of said housing to define a storage position;

said tray having a perimeter lip whereby said tray is adapted for preventing objects from sliding off of said tray when said tray is moved between said extended position and said storage position;

a hook coupled to said interior back face of said housing, said hook extending outwardly from said interior back face of said housing such that said hook is adapted for holding an item over said tray when said tray is in said storage position;

a nozzle clip member coupled to said interior back face of said housing, said nozzle clip member being for holding said nozzle when said nozzle is not being used;

a waste basket positioned inside said housing, said waste basket being for placing on said tray;

a soap dispenser for positioning on said tray, said soap dispenser being for selectively dispensing soap upon depression of a pump of said soap dispenser;

a front cover for selectively covering said open front face of said housing when said tray is in said storage position, said front cover being a rolling cover having a top edge positioned within an upper cover track and a lower portion positioned with a lower cover track, said cover having a first end coupled to a spool, said spool being rotatable around a longitudinal axis of said spool, said spool being for holding said cover when said cover is in an open position, said open position being defined by said front cover being wrapped around said spool for providing access to said interior space of said housing, said front cover being extendable into a closed position defined by said front cover covering said open front face of said housing for preventing access to said interior space of said housing; and said front cover having a handle positioned proximate a distal end of said front cover opposite said first end, said handle being for facilitating movement of said front cover between said open position and said closed position.

* * * * *